US007267560B2

(12) United States Patent
Akino

(10) Patent No.: US 7,267,560 B2
(45) Date of Patent: Sep. 11, 2007

(54) CONDENSER MICROPHONE CONNECTION PLUG

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 70 days.

(21) Appl. No.: 11/269,629

(22) Filed: Nov. 9, 2005

(65) Prior Publication Data

US 2006/0098835 A1 May 11, 2006

(30) Foreign Application Priority Data

Nov. 11, 2004 (JP) ..... 2004-327186

(51) Int. Cl.
*H01R 13/648* (2006.01)

(52) U.S. Cl. ..... 439/101; 439/927

(58) Field of Classification Search ..... 439/101, 439/607, 609, 927, 95, 939
See application file for complete search history.

(56) References Cited

U.S. PATENT DOCUMENTS 2,523,664 A * 9/1950 Minnium et al. ..... 361/303
3,670,292 A * 6/1972 Tracy ..... 439/608
3,825,874 A * 7/1974 Peverill ..... 439/579
4,408,816 A * 10/1983 Knecht ..... 439/610
4,440,463 A * 4/1984 Gliha et al. ..... 439/92

* cited by examiner

*Primary Examiner*—Tho D. Ta
*Assistant Examiner*—Vanessa Girardi
(74) *Attorney, Agent, or Firm*—Manabu Kanesaka

(57) ABSTRACT

The present invention prevents noise attributed to an electromagnetic wave by reducing a high-frequency impedance at the connection between a microphone case and a connection plug of an output cable. The present invention provides a condenser microphone including a microphone case 10 having a connector housing section 13 for an output connector 20, and a connection plug 41 which is provided on a balanced shield cable 40 and which is inserted into the connector housing section 13, the connection plug 41 having an insertion portion 42 provided with a grounding outer ring 44 which contacts an inner surface of the connector housing section 13 to electrically connect to the microphone case, wherein a ring-like metal connection member 30 is placed on an outer surface of a pedestal 21 of the output connector 20, the ring-like metal connection member 30 including a plurality of contactors 32 arranged like petals and each partly having a bent portion, the metal connection member 30 having a diameter smaller than an inner diameter of the connector housing section 13 under no load, and when the insertion portion 42 is inserted into the connector housing section 13, contacting the outer ring 44 and has its diameter increased by a resulting pressing force to electrically connect a free end of each of the contactors 32 to an inner surface of the connector housing section 13.

3 Claims, 3 Drawing Sheets

CONDENSER MICROPHONE CONNECTION PLUG

TECHNICAL FIELD

The present invention relates to a condenser microphone connection plug, and more specifically, to a shield technique for the microphone condenser.

BACKGROUND ART

A condenser microphone comprises a microphone unit having a diaphragm and a fixed pole arranged opposite each other. Since the microphone unit has a very high impedance, the condenser microphone also contains an impedance converter. The impedance converter is normally composed of an FET (Field Effect Transistor) but in rare cases, of a vacuum tube.

An electronic circuit for audio output from the condenser microphone is mounted on a substrate, which is then housed in a microphone case consisting of a metal cylinder. Normally, a connector housing section is provided at one end of the microphone case. A 3-pin type output connector (3-pin output connector) defined in EIAJ RC5236 (latch lock type round connector for audio equipment) is installed in the connector housing section.

In operation, the output connector is connected to a phantom power source via an output cable (balanced shield cable) having a connection plug to which the output connector is connected. The connection plug comprises three female contacts corresponding to the three pins (ground, a hot side of a signal, and a cold side of a signal) of the output connector, and a metal outer ring connected to a shield coated wire. When inserted into the connector housing, the outer ring contacts an inner surface of the connector housing to electrically connect to the microphone case.

When an intense electromagnetic wave emitted by, for example, a cellular phone is applied to the microphone or output cable, it may be transmitted through the output cable to enter the microphone via the output connector. Then, the electromagnetic wave is demodulated by the impedance converter and output by the microphone as noise of an audible frequency.

To prevent this, a grounding first pin, one of the three pins of the output connector, is connected to the microphone case. Further, the outer ring of the connection plug connected to the shield coated wire of the outer cable is contacted with and electrically connected to the inner surface of the microphone case (the inner surface of the connector housing section). The microphone case is thus provided with a shield function.

However, since the connector housing section and the outer ring of the connection plug are subjected to cylindrical female-male fitting, they are contacted with each other at a point. The point contact portion has an impedance for a high frequency to make the shielding incomplete. Further, if the connector housing section and the outer ring of the connection plug are loose owing to a dimensional error or the like, the contact point cannot be established, thus making the shielding unstable. Such incomplete and unstable shielding results in noise attributed to the electromagnetic wave. Further, the looseness of the fitted portion may result in vibration noise.

SUMMARY OF THE INVENTION

It is thus an object of the present invention to prevent noise attributed to an electromagnetic wave by reducing a high-frequency impedance at the connection between a microphone case and an outer ring of a connection plug of an output cable to provide a microphone case with a stable shield function.

To accomplish this object, the present invention provides a condenser microphone including a microphone case comprising a metal cylinder and having a connector housing section at one end, a 3-pin output connector which has three pins penetrating an electrically insulating pedestal and which is installed in the connector housing section, and a connection plug which is provided on a balanced shield cable and which is connected to the 3-pin output connector when inserted into the connector housing section, the connection plug having a cylindrical insertion portion provided with a metal outer ring which is electrically connected to a shield coated wire in the balanced shield cable and which contacts an inner surface of the connector housing section to electrically connect to the microphone case, wherein a ring-like metal connection member comprising a leaf spring material is placed along an outer surface of the pedestal of the 3-pin output connector, and the metal connection member includes a plurality of contactors arranged like petals and each partly having a bent portion, and wherein the metal connection member has a diameter smaller than an inner diameter of the connector housing section under no load, and when the insertion portion is inserted into the connector housing section, the metal connection member contacts the outer ring and has its diameter increased by a resulting pressing force to electrically connect a free end of each of the contactors to an inner surface of the connector housing section.

With this configuration, when the connection plug is inserted into the connector housing section, the outer ring of the insertion portion contacts each of contactors of the ring-like metal connection member comprising the leaf spring material. Further, the contactors are opened and electrically connected to the inner surface of the connector housing section. This firmly contacts the microphone case with the outer ring of the connection plug over a wide area.

In preferred aspects, each of the contactors comprises a semicircular bent portion at its free end, and is formed so as to be entirely bent with a predetermined curvature.

Consequently, the high-frequency impedance at the connection decreases, and it stabilizes the shield function of the microphone case. It is thus possible to effectively prevent noise attributed to an electromagnetic wave and reduce vibration noise. Moreover, the ring-like metal connection member has a diameter smaller than the inner diameter of the connector housing section under no load. Therefore, the metal connection member can be applied directly to existing condenser microphones.

DETAILED DESCRIPTION

Figure 1:
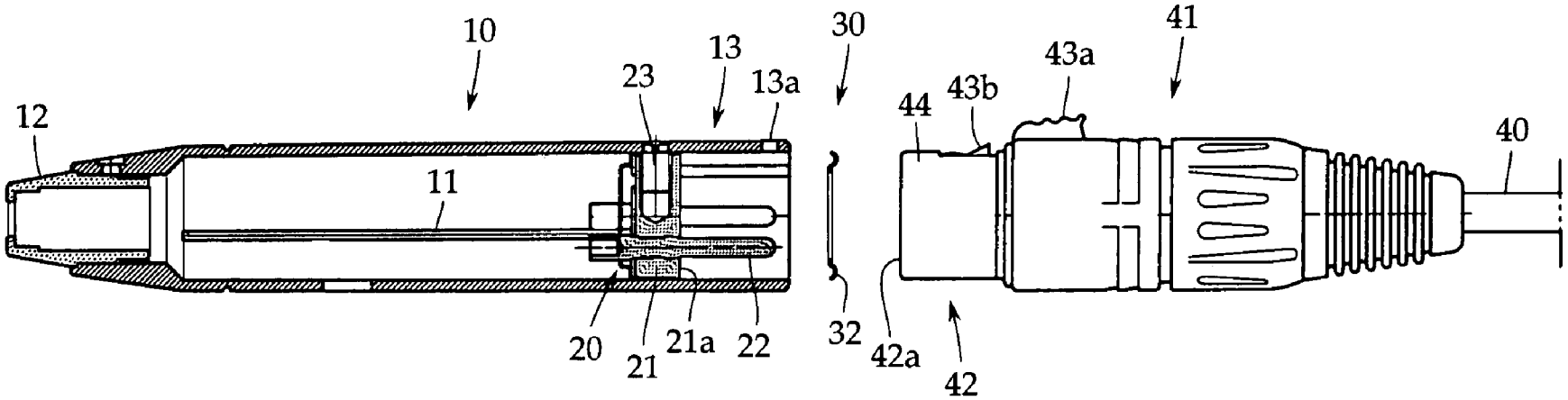
FIG. 1 is a sectional view separately showing a microphone case provided in a condenser microphone and a connection plug of an output cable in accordance with the present invention.
Figure 2A:
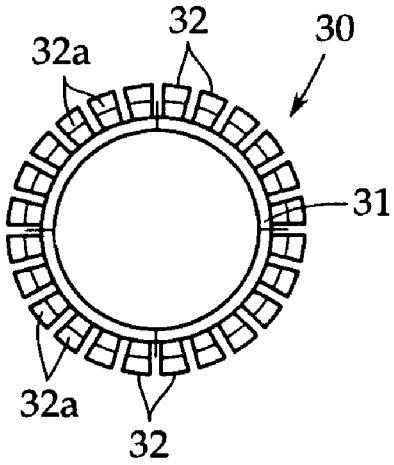
FIG. 2A is a front view showing a metal connection member provided in the microphone case.
Figure 2B:
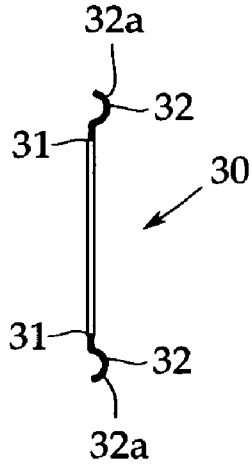
FIG. 2B is a sectional view of FIG. 2A.
Figure 2C:
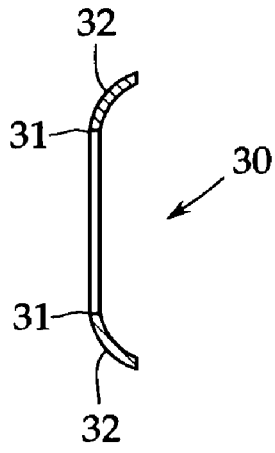
FIG. 2C is a sectional view showing a variation of the metal connection member.
Figure 3:
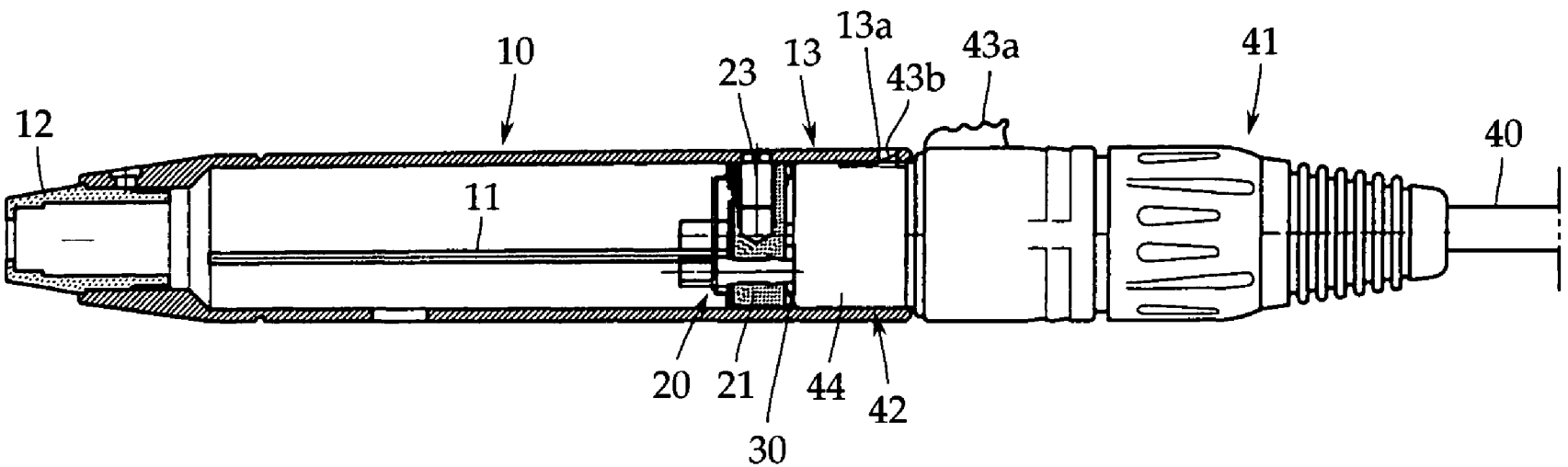
FIG. 3 is a sectional view showing how the microphone case is connected to a connection plug.

Now, embodiments of the present invention will be described with reference to FIGS. 1 to 3. However, the present invention is not limited to this. FIG. 1 is a sectional view separately showing a microphone case provided in a condenser microphone and a connection plug of an output cable in accordance with the present invention. FIG. 2A is a front view showing a metal connection member provided in the microphone case. FIG. 2B is a sectional view of FIG. 2A. FIG. 2C is a sectional view showing a metal connection member in accordance with a variation. FIG. 3 is a sectional view showing how the microphone case is connected to a connection plug.

A microphone case 10 shown in FIG. 1 is used for a sound output module section of a separable condenser microphone such as a gooseneck microphone or a tiepin microphone in which a condenser microphone unit and a sound output module section are connected together via a microphone cable.

The condenser microphone unit is well-known and is thus not shown in the drawings. The sound output module section is provided with a polarized power supply circuit for the condenser microphone unit. Accordingly, the sound output module section may be called a power module section.

The microphone case 10 consists of a cylinder formed by die-casting, for example, zinc or aluminum. A substrate 11 is housed in the microphone case 10; a sound output circuit or the polarized power supply circuit is mounted on the substrate 11. A microphone cable (not shown) drawn into the microphone case 10 is soldered to the substrate 11. The microphone case 10 has a cord bush 12 for the microphone cable attached to one end.

The other end of the microphone case 10 constitutes a connector housing section 13 in which an output connector 20 is installed. The output connector 20 is of a 3-pin type defined in EIAJ RC5236 (latch lock type round connector for audio equipment).

The output connector 20 comprises three pins, a grounding first pin that penetrates a pedestal 21 made of a synthetic resin, a second pin for a hot side of a signal, and a third pin for a cold side of the signal. However, FIG. 1 is a sectional view and thus shows only two pins. A cross section of the grounding first pin 22 is shown, and the grounding first pin 22 is electrically connected to the microphone case 10 via a metal conductive plate (not shown). The output connector 20 is firmly fixed to the interior of the connector housing section 13 using a fixing thread 23 formed in the pedestal 21.

In operation, the output connector 20 is connected to a phantom power source (not shown) via an output cable 40 consisting of a balanced shield cable. Thus, the output cable 40 is provided with a connection plug 41 that can be connected to and disconnected from the output connector 20.

The connection plug 41 has a cylindrical insertion portion 42 inserted into the connector housing section 13. Although not shown, three female contacts are arranged in the insertion portion 42 in association with the three pins of the output connector 20. A metal outer ring 44 is provided in an outer peripheral portion of the insertion portion 42; the outer ring 44 is electrically connected to a shield coated wire (not shown) in the output cable. Although not shown in detail, an end of the outer ring 44 is folded onto an end surface 42*a* of the insertion portion 42.

Further, the connection plug 41 is of the latch lock type. Accordingly, the connection plug 41 comprises a locking pawl 43*b* operated using a knob 43*a*. A locking hole 13*a* is drilled in the connector housing section 13 so that the locking pawl 43*b* is locked in the locking hole 13*a*. The locking pawl 43*b* is always urged by spring means (not shown) in a direction in which it is projected. Inserting the insertion portion 42 into the connector housing section 13 automatically locks the locking pawl 43*b* in the locking hole 13*a*. Pushing the knob 43*a* unlocks the insertion portion 42.

As described above, when the insertion portion 42 of the connection plug 41 is inserted into the connector housing section 13, the three pins are connected to the three female contacts. Further, the outer ring 44 contacts the inner surface of the connector housing section 13 to provide the microphone case 10 with a shield function. However, in the present invention, a ring-like metal connection member 30 is provided in the connector housing section 13 in order to reduce a high-frequency impedance at the contact portion and to prevent the contact portion from coming loose.

As shown in the front view in FIG. 2A, the metal connection member 30 includes a base ring 31 and a plurality of contactors 32 arranged along an outer periphery of the base ring 31 like petals. The base ring 31 and the contactors 32 are integrally formed of a leaf spring material such as phosphor bronze.

The inner diameter of the base ring 31 is such that the base ring 31 does not contact any of the three pins of the output connector 20. As shown in the sectional view in FIG. 2B, each of the contactors 32 comprises a semicircular bent portion 32*a* at its free end which projects in the same direction. The bent portion 32*a* is located at an opposite side of the end of the outer ring 44 folded onto the end surface 42*a* of the insertion portion 42.

The diameter including the free end of each contactor 32 corresponds to the outer diameter of the metal connection member 30. However, the dimension of the outer diameter is not fixed. That is, the outer diameter of the metal connection member 30 is smaller than the inner diameter of the connector housing section 13 under no load (natural state). However, collapsing the bent portions 32*a* increases the outer diameter of the metal connection member 30 to contact the free end of each contactor 32 with the inner surface of the connector housing section 13. Consequently, the metal connection member 30 can be placed in the connector housing section 13 of an existing microphone after assembly.

In FIG. 1, an outer surface 21*a* of the pedestal 21, provided in the output connector 20, corresponds to a right surface (surface closer to the connector housing section 13) of the pedestal 21. The metal connection member 30 is attached to the outer surface 21*a* of the pedestal 21 so that the bent portions 32*a* face toward the connection plug 41.

During the attachment, not all the contactors 32 need to avoid contacting the inner surface of the connector housing section 13. Some of the contactors 32 may contact the inner surface of the connector housing section 13. An adhesive or the like may be used to fix the metal connection member 30.

As shown in FIG. 3, the insertion portion 42 of the connection plug 41 is inserted into the connector housing section 13. The locking pawl 43*b* on the insertion portion 42 is then locked in the locking hole 13*a*. Then, the bent portion 32*a* of each contactor 32 contacts the end of the outer ring 44 folded onto the end surface 42*a* of the insertion portion 42. The bent portion 32*a* is thus elastically deformed by the resulting pressing force so as to be crushed. Consequently, the free end of each contactor 32 is opened and contacts the inner surface of the connector housing section 13.

This allows the outer ring 44 of the insertion portion 42 to be reliably electrically connected to the connector housing section 13. The high-frequency impedance at the contact portion thus decreases. Further, the reaction force of the bent portion 32*a* firmly fixes the insertion portion 42 in the connector housing section 13. This prevents the contact portion from coming loose, thus preventing the vibration noise problem.

In a variation, as shown in FIG. 2C, each contactor 32 of the metal connection member 30 may be entirely bent from its base ring 31 side to the free end so as to have a predetermined curvature. Also in this case, the metal connection member 30 is attached to the pedestal 21 in the output connector 20 so that the bent concave surface of each contactor 32 faces toward the connection plug 41.

According to the variation, the concave surfaces of the contactors 32 of the metal connection member 30 contact corners of the outer ring 44 of the insertion portion 42. The pressing force of the insertion portion 42 pushes the contactors 32 to open to contact them with the inner surface of the connector housing section 13. The variation exerts effects similar to those of the above example. In the variation, preferably, the free ends of the contactors 32 are, for example, rounded so as to avoid contacting the inner surface of the connector housing section 13 tightly.

The present invention has been described by illustrating the case of the separable condenser microphone in which the condenser microphone unit and the output module section are connected together using the microphone cord. However, the present invention includes a condenser microphone having a microphone case with a 3-pin output connector connected to a connection plug of an output cable (balanced shield cable), for example, a hand-held integral condenser microphone having a microphone case used as a microphone grip.

The present application is based on, and claims priority from, Japanese Application Serial Number JP2004-327186, filed Nov. 11, 2004, the disclosure of which is hereby incorporated by reference herein in its entirety.

The invention claimed is:

1. A condenser microphone connection plug including a microphone case comprising a metal cylinder and having a connector housing section at one end, a 3-pin output connector which has three pins penetrating an electrically insulating pedestal and which is installed in the connector housing section, and a connection plug which is provided on a balanced shield cable and which is connected to the 3-pin output connector when inserted into the connector housing section, the connection plug having a cylindrical insertion portion provided with a metal outer ring which is electrically connected to a shield coated wire in the balanced shield cable and which contacts an inner surface of the connector housing section to electrically connect to the microphone case, wherein a ring-like metal connection member comprising a leaf spring material is placed along an outer surface of the pedestal of the 3-pin output connector, and the metal connection member includes a plurality of contactors arranged like petals and each partly having a bent portion, and wherein the metal connection member has a diameter smaller than an inner diameter of the connector housing section under no load, and when the insertion portion is inserted into the connector housing section, the metal connection member contacts the outer ring and has its diameter increased by a resulting pressing force to electrically connect a free end of each of the contactors to an inner surface of the connector housing section.

2. The condenser microphone connection plug according to claim 1, wherein each of the contactors comprises a semicircular bent portion at its free end.

3. The condenser microphone connection plug according to claim 2, wherein each of the contactors is formed so as to be entirely bent with a predetermined curvature.

* * * * *